US007765753B1

(12) United States Patent
Shriver

(10) Patent No.: US 7,765,753 B1
(45) Date of Patent: Aug. 3, 2010

(54) INTERLOCKING CURTAIN WALL INSULATION SYSTEM

(75) Inventor: James C. Shriver, Wabash, IN (US)

(73) Assignee: Thermafiber, Inc., Wabash, IN (US)

( * ) Notice: Subject to any disclaimer, the term of this patent is extended or adjusted under 35 U.S.C. 154(b) by 32 days.

(21) Appl. No.: 12/166,628

(22) Filed: Jul. 2, 2008

Related U.S. Application Data

(63) Continuation of application No. 10/841,093, filed on May 7, 2004, now Pat. No. 7,424,793.

(51) Int. Cl.
*E04H 1/00* (2006.01)

(52) U.S. Cl. ..... 52/235; 52/404.2; 52/407.2

(58) Field of Classification Search ..... 52/235, 52/404.2, 407.2, 506.05, 511
See application file for complete search history.

(56) References Cited

U.S. PATENT DOCUMENTS

| | | | | | |
|---|---|---|---|---|---|
| 2,007,683 | A | | 7/1935 | Kreutzer | |
| 2,294,556 | A | * | 9/1942 | Henderson | 52/206 |
| 2,702,104 | A | * | 2/1955 | Harrison et al. | 52/61 |
| 2,885,040 | A | | 5/1959 | Grossman | |
| 3,110,131 | A | * | 11/1963 | Jeffress | 52/396.04 |
| 3,176,806 | A | | 4/1965 | Ferrell | |
| 3,266,207 | A | * | 8/1966 | Birum, Jr. | 52/459 |
| 3,357,144 | A | | 12/1967 | Chauveau et al | |
| 3,466,825 | A | * | 9/1969 | Guddal | 52/344 |
| 3,604,167 | A | | 9/1971 | Hays | |
| 3,685,228 | A | * | 8/1972 | Pauley | 52/506.05 |
| 3,715,848 | A | | 2/1973 | Jordan | |
| 3,729,878 | A | | 5/1973 | Termohlen et al. | |
| 3,738,217 | A | | 6/1973 | Walker | |
| 3,755,980 | A | * | 9/1973 | Weidlinger | 52/235 |
| 3,786,604 | A | | 1/1974 | Kramer | |
| 3,815,309 | A | * | 6/1974 | Olsen | 52/506.08 |
| 3,913,287 | A | * | 10/1975 | Chapman, Jr. | 52/94 |
| 3,936,986 | A | * | 2/1976 | Steel | 52/235 |
| 3,994,107 | A | | 11/1976 | Aughuet | |
| 4,194,333 | A | * | 3/1980 | Paton et al. | 52/235 |
| 4,221,095 | A | | 9/1980 | Weinar | |
| 4,250,678 | A | * | 2/1981 | Skuran | 52/478 |
| 4,291,511 | A | | 9/1981 | Stoakes | |
| 4,346,543 | A | | 8/1982 | Wilson et al. | |
| 4,423,576 | A | * | 1/1984 | Farina et al. | 52/235 |
| 4,449,341 | A | | 5/1984 | Taglianetti et al. | |
| 4,453,355 | A | * | 6/1984 | Stoakes | 52/235 |

(Continued)

FOREIGN PATENT DOCUMENTS

| | | | |
|---|---|---|---|
| CH | 679055 | A * | 12/1991 |

(Continued)

*Primary Examiner*—Richard E Chilcot, Jr.
*Assistant Examiner*—Mark R Wendell
(74) *Attorney, Agent, or Firm*—James E Cole; Middleton Reutlinger

(57) ABSTRACT

An interlocking curtain wall insulation system for a building having a backer bar spaced from a floor slab defining a perimeter void between the floor slab and an outer wall, a safing insulation disposed above the backer bar and compression fit within the perimeter void between the floor slab and the backer bar, a first curtain wall insulation extending from an upper surface of the safing insulation adjacent the backer bar, a second curtain wall insulation depending from the backer bar.

16 Claims, 8 Drawing Sheets

U.S. PATENT DOCUMENTS

| | | | | | |
|---|---|---|---|---|---|
| 4,506,482 | A | * | 3/1985 | Pracht et al. | 52/235 |
| 4,546,582 | A | | 10/1985 | Gartner | |
| 4,561,228 | A | * | 12/1985 | Kaminaga | 52/235 |
| 4,570,400 | A | * | 2/1986 | Slager et al. | 52/235 |
| 4,571,905 | A | * | 2/1986 | Kaminaga | 52/235 |
| 4,574,546 | A | * | 3/1986 | Gartner | 52/235 |
| 4,597,702 | A | | 7/1986 | Brown | |
| 4,611,447 | A | | 9/1986 | Krechel | |
| 4,660,343 | A | | 4/1987 | Raycher et al. | |
| 4,842,465 | A | | 6/1989 | Pease et al. | |
| 4,984,405 | A | | 1/1991 | Sauder | |
| 5,010,706 | A | | 4/1991 | Sauder | |
| 5,060,429 | A | * | 10/1991 | Pitts et al. | 52/127.7 |
| 5,063,718 | A | * | 11/1991 | Nonis | 52/235 |
| 5,158,392 | A | | 10/1992 | Takeda | |
| 5,299,403 | A | * | 4/1994 | Fentz | 52/404.2 |
| 5,467,566 | A | * | 11/1995 | Swartz et al. | 52/235 |
| 5,473,851 | A | * | 12/1995 | Northrup, Jr. | 52/513 |
| 5,502,937 | A | | 4/1996 | Wilson | |
| 5,673,529 | A | * | 10/1997 | Treister et al. | 52/511 |
| 5,765,332 | A | | 6/1998 | Landin et al. | |
| 5,956,910 | A | * | 9/1999 | Sommerstein et al. | 52/235 |
| 6,058,668 | A | | 5/2000 | Herren | |
| 6,098,364 | A | * | 8/2000 | Liu | 52/506.08 |
| 6,427,410 | B1 | * | 8/2002 | Lind | 52/508 |
| 6,857,233 | B2 | | 2/2005 | Farag | |
| 7,134,247 | B2 | | 11/2006 | Ting | |
| 7,293,393 | B2 | * | 11/2007 | Kelly et al. | 52/665 |
| 2002/0011042 | A1 | * | 1/2002 | Lippy et al. | 52/512 |
| 2002/0148178 | A1 | * | 10/2002 | Farag | 52/204.1 |
| 2003/0033764 | A1 | * | 2/2003 | Ting | 52/235 |
| 2003/0070379 | A1 | * | 4/2003 | Worley | 52/506.05 |
| 2003/0101669 | A1 | * | 6/2003 | Toulemonde et al. | 52/251 |
| 2003/0126823 | A1 | * | 7/2003 | McManus | 52/712 |
| 2005/0246983 | A1 | * | 11/2005 | Loyd | 52/235 |
| 2007/0062140 | A1 | | 3/2007 | Sillik | |
| 2007/0204540 | A1 | * | 9/2007 | Stahl et al. | 52/274 |
| 2009/0126297 | A1 | * | 5/2009 | Stahl, Jr. | 52/235 |

FOREIGN PATENT DOCUMENTS

| | | | | |
|---|---|---|---|---|
| DE | 3145647 | A1 | * | 5/1983 |
| EP | 100431 | A1 | * | 2/1984 |
| EP | 489669 | A1 | * | 6/1992 |
| GB | 2142952 | A | * | 1/1985 |
| GB | 2148970 | A | * | 6/1985 |
| GB | 2160238 | A | * | 12/1985 |
| JP | 02070866 | A | * | 3/1990 |
| JP | 03013644 | A | * | 1/1991 |
| JP | 03183840 | A | * | 8/1991 |

* cited by examiner

INTERLOCKING CURTAIN WALL INSULATION SYSTEM

CROSS REFERENCES TO RELATED APPLICATIONS

This application is a continuation patent application of and claims priority to and benefit from, U.S. patent application Ser. No. 10/841,093, filed on May 7, 2004, now U.S. Pat. No. 7,424,793, issued Sep. 16, 2008.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates to a curtain wall insulation system which insulates adjacent floors. More specifically, the present invention relates to an interlocking curtain wall insulation which inhibits spread of fire from one floor to an upper adjacent floor through perimeter voids between an edge of a floor slab and the exterior building structure.

2. Description of the Related Art

Building structures utilize constructions combining steel, to provide a skeletal structure for the building, and concrete to provide floor structure. Accordingly, concrete is poured, or positioned in preformed slabs, from one side of the building to an opposed side. At interfaces between the concrete floor and exterior walls of the building, the perimeter voids are provided so that the building structure may be formed square and aesthetically pleasing, even though the concrete slab may not be. The perimeter voids provide an indirect advantage in that they accommodate for the difference in thermal expansion between the structural steel and the concrete floor slab.

However, providing such a perimeter void presents problems in fire retardance and suppression. During fires in building structures of the type previously described, the aforementioned perimeter voids provide a means for air movement between floors and act as a flue for the rise of hot gas during fire conditions. More problematic is the spread of flames and hot gases from one floor to another through the perimeter voids which consequently allow fire to spread throughout a building.

Various designs have been contemplated in order to inhibit the spread of fire throughout a building. For example, one design comprises a trough device disposed within the thermal expansion gap wherein the trough is filled with urea formaldehyde foam. However this design fails to provide means to interconnect the trough and curtain wall on the outside edge of the trough. Thus air gaps may form between the trough and curtain wall allowing the rise of smoke, flames, and hot gases. Alternatively, fire insulation, or safing insulation as it is typically termed, has been positioned in the thermal expansion gap between the curtain wall and floor slab. However, since the curtain wall structure is typically held in place by aluminum, during fire conditions, the aluminum structure can weaken or melt allowing the curtain wall to move slightly and further allowing the safing insulation to fall from its position between the floor slab and curtain wall.

Given the foregoing deficiencies, it will be appreciated that an interlocking curtain wall insulation system is needed which is held in place by interconnection with alternate parts of the curtain wall system so that the perimeter voids are closed inhibiting the spread of flame and hot gases.

SUMMARY OF THE INVENTION

With regard to the foregoing, the present invention eliminates the oversights, difficulties, and disadvantages of the prior art by providing an interlocking curtain wall insulation system.

An object of the present invention is to provide an interlocking curtain wall insulation which inhibits passage of smoke, flame and hot gases from one floor to an adjacent floor through the perimeter void between the slab edge and exterior curtain wall.

An additional object of the present invention is to provide an interlocking curtain wall insulation system which is easy to manufacture and install.

Another object of the present invention is to provide an interlocking curtain wall system which interlocks by utilizing a plurality of parts in compression with one another.

Yet another object of the present invention is to provide interlocking insulation which inhibits fire damage and heat exposure in order to maintain structural integrity of the system.

According to the present invention, an interlocking curtain wall insulation system is provided. The interlocking curtain wall insulation system comprises a frame connected to a building structure having at least first and second parallel transoms, at least first and second parallel mullions, the at least first and second parallel transoms operably engaging the at least first and second parallel mullions. The device further comprises an insulation having a safing insulation extending between a floor slab and the backer bar and compressively fit therein, an upper curtain wall insulation depending from an upper insulation hanger and compressing the safing insulation, and a lower curtain wall insulation depending from a lower insulation hanger. Mullion covers may be installed adjacent the upper and lower curtain wall insulations in order to protect the mullions from exposure to flame and hot gases.

DETAILED DESCRIPTION

Referring now in detail to the drawings, wherein like numerals indicate like elements throughout the several views, there are shown in FIGS. 1 through 8 various aspects of an interlocking curtain wall system. The system includes a curtain wall structure, curtain wall insulation, and safing insulation arranged in compression to interlock with each other thus inhibiting the spread of flame and hot gases through adjacent floors of a high rise building. More specifically flame and hot gases are inhibited from spreading through perimeter voids between the curtain wall and the perimeter of a floor slab in a building structure.

Figure 1:
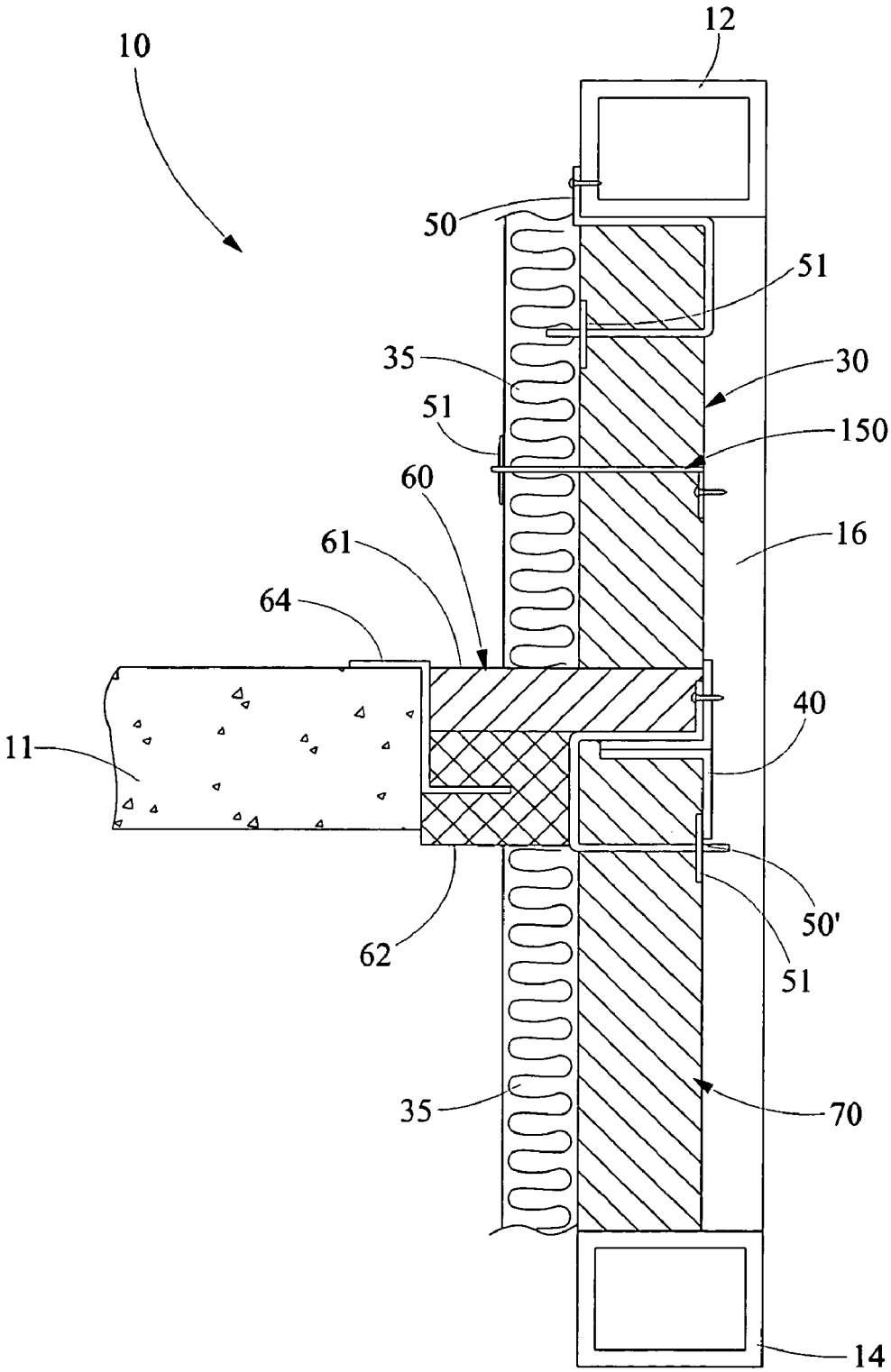
FIG. 1 is a side sectional view of the interlocking curtain wall insulation system of the present invention.
Figure 2:
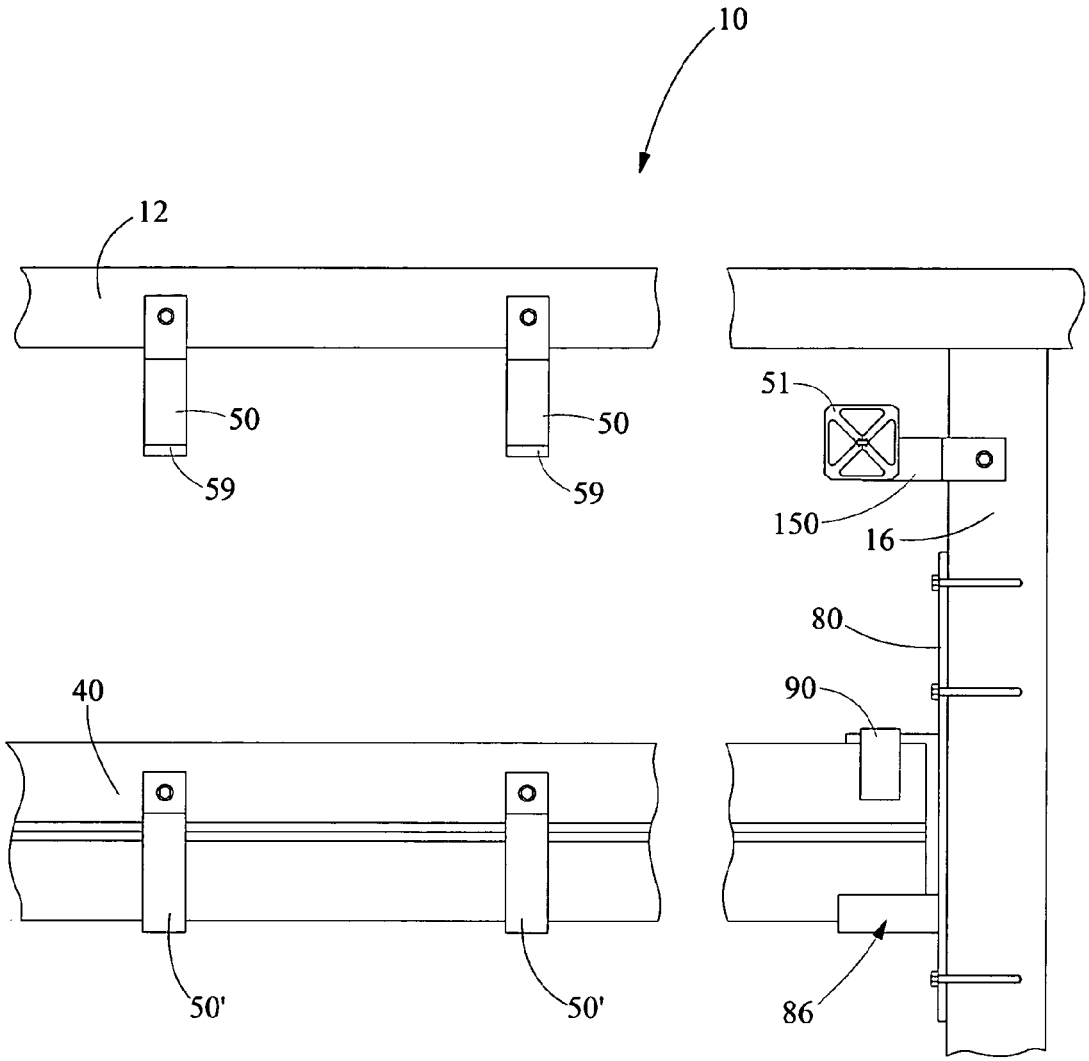
FIG. 2 is a front view of the interlocking curtain wall of FIG. 1.

Referring initially to FIG. 1, a side sectional view of an interlocking curtain wall system 10 of the present invention is depicted. As shown therein, the interlocking curtain wall system 10 provides an upper horizontally extending transom 12 and a lower horizontally extending transom 14 which are depicted as extending into the page. The transoms 12,14 are typically formed of a lightweight material, such as for example aluminum, since they are not structural members but instead are utilized to attach curtain wall insulation to the structure of the building. As shown in FIG. 2, the interlocking curtain wall system 10 is also positioned between vertical mullions 16 which thereby provide a frame for various sections of the interlocking curtain wall system 10. The mullions 16 and transoms 12,14 provide a framing extending about spandrel openings in a building structure.

Figure 4:
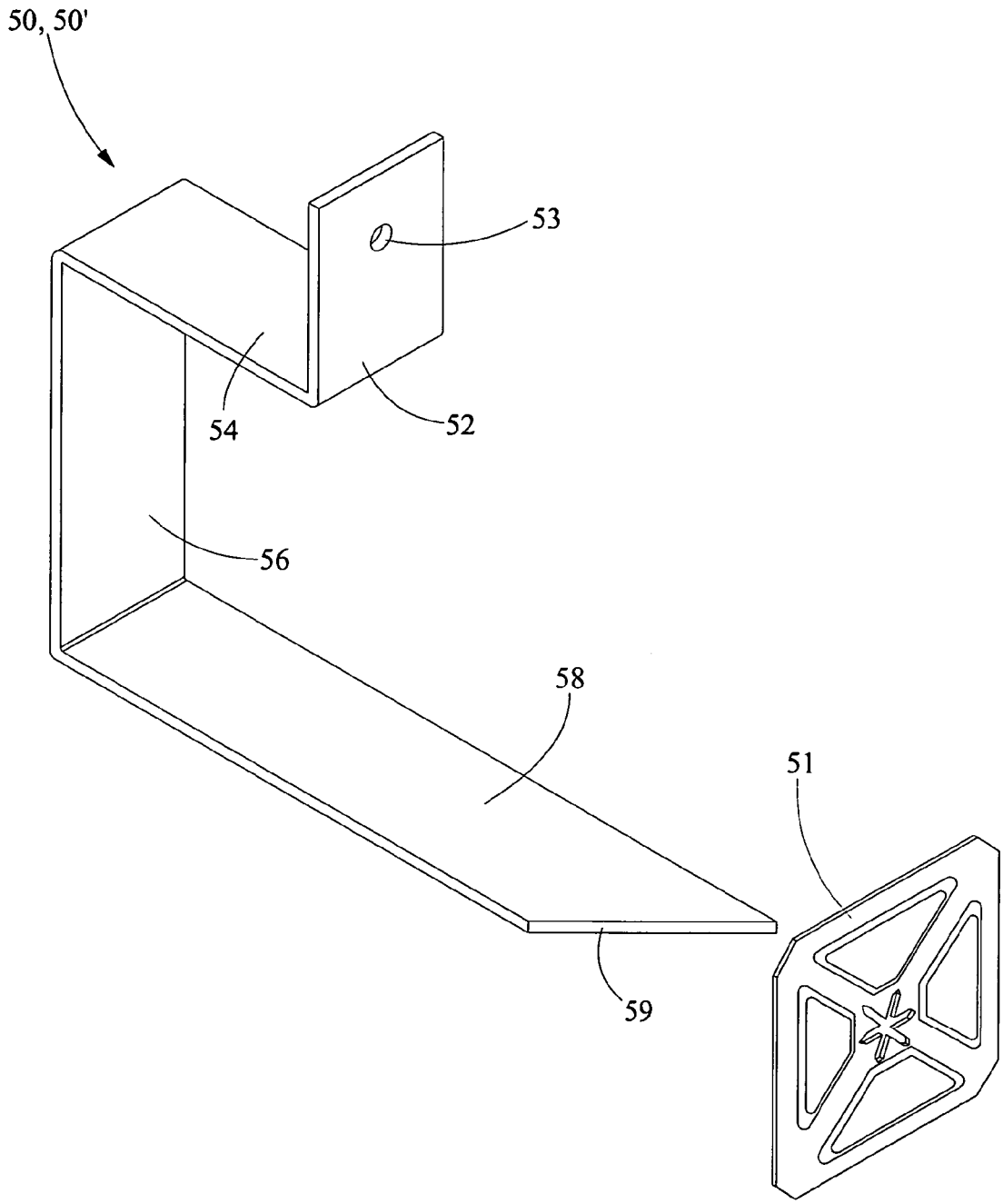
FIG. 4 is a perspective view of the insulation hanger utilized in the interlocking curtain wall of FIG. 1.

Referring now to FIGS. 1, 2 and 4, depending from the upper horizontally extending transom 12 is at least one upper insulation hanger 50. The at least one upper insulation hanger 50 is fastened or otherwise affixed to the upper transom 12 by fastener or other fixative and is formed of a relatively heat resistant material such as, for example, steel, galvanized steel, porcelain or other ceramic material. It may be preferable that such materials are similar in nature to inhibit corrosion caused by contact of dissimilar metals. Referring now to FIGS. 1 and 4, the upper insulation hanger 50 may be substantially C-shaped with an additional at least one upper leg 52 extending from an upper portion of the insulation hanger 50. The hanger 50 is further defined by horizontal legs 54 and 58 and a vertical leg 56 extending between the horizontal legs 54 and 58. The lower horizontal leg 58 opposite the vertical leg 56 comprises an end 59 cut at an angle illustrated as about 45 degrees. The 45 degrees angle impales the first upper curtain wall insulation 30 in order to retain the upper curtain wall insulation 30 in place. The at least one upper leg 52 includes a fastening aperture 53 wherein a fastener may be positioned to connect the at least one upper leg 52 to the upper transom 12. The upper insulation hangers 50 may be floating and may for example be spaced apart on twelve inch centers (12") or other distances based on the size and weight characteristics of the curtain wall insulation and the size of the upper transom 12. However, it is well within the scope of the present invention to vary the shape and positioning of the upper insulation hangers 50 depending from the upper transom 12 from which an upper curtain wall 30 is supported in order to accommodate various sizes of transoms and varying thickness of mineral wool.

As shown in FIGS. 1 and 4 the upper leg 52 of the upper support hanger 50 is positioned against a vertical surface of the upper transom 12. With the upper insulation hanger 50 configured as shown in FIG. 1, the upper horizontal leg 54 is disposed against the lower horizontal surface of the upper transom 12. The upper leg 52 includes a fastening aperture 53 through which a fastener may be positioned to attach the upper insulation hanger 50 and the transom 12. Although not depicted, an additional fastener may also be positioned through the upper horizontal leg 54 and into the transom 12 if desired to provide a better connection between the upper insulation hanger 20 and the upper transom 12. In any event, the lower horizontal leg 58 is positioned so as to receive and support curtain wall material 30 thereon.

As further shown in FIGS. 1 and 4, a flat lock washer 51 may be installed on the upper support hanger 50,50' by sliding the washer 51 over the end 59. The lock washer is shown as being substantially square but may vary in shape. The lock washer 51 further includes a centrally disposed slot which allows passage of the end 59 of hanger 50, for example. Metal to metal contact between the lock washer 51 and hanger 50,50' locks the washer in place. One of ordinary skill in the art will also recognize that once the hanger 50,50' is installed, a curtain wall material 30,70 is installed and engages the hanger 50,50' and a lock washer 51 is installed on the hanger 50,50' to retain the curtain wall insulation 30,70 in place. Such washers 51 are not shown in FIG. 2 for purpose of clarity.

Figure 7:
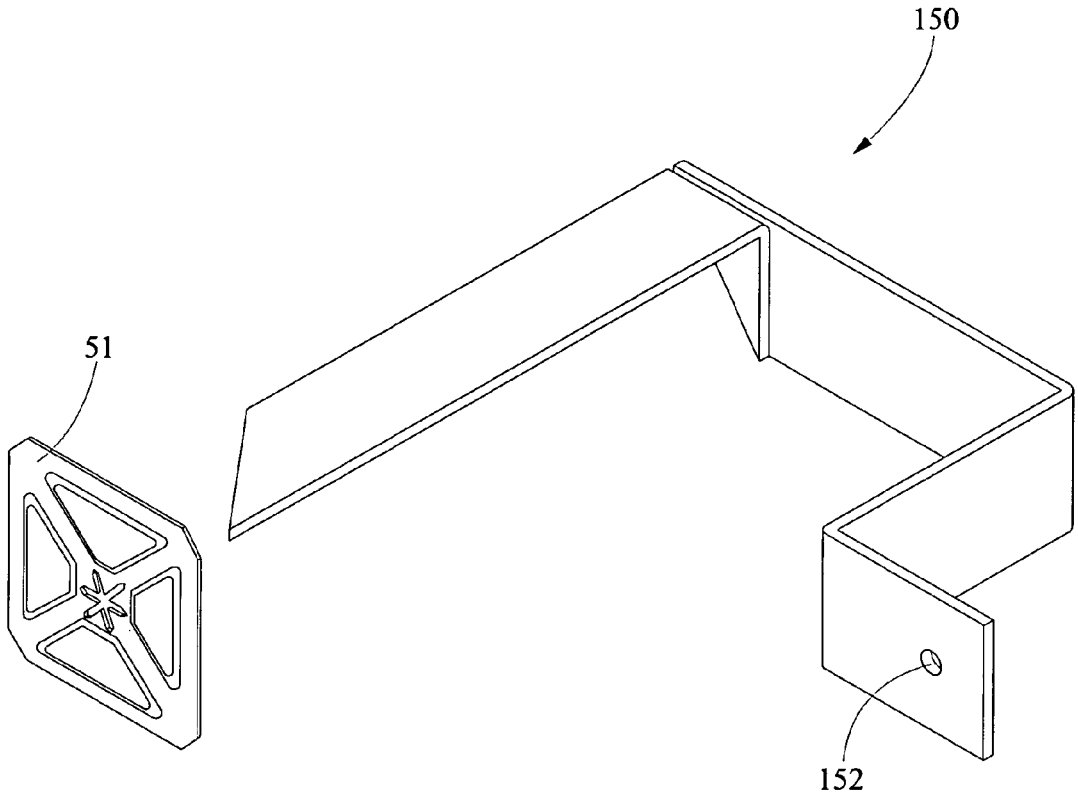
FIG. 7 is a perspective view of a mullion cover bracket shown in FIG. 2; and, FIG. 8 is a perspective view of a Z-clip of the present invention.

Referring to FIGS. 1, 2 and 7 the mullion cover brackets 150 are shown and are utilized to attach mullion covers 35 in order to protect the mullions 16 from hot flame and gases. The brackets 150 are similar to the insulation hangers 50 except that the lower leg is rotated about an axis extending the length of the lower leg. The brackets 150 are fastened to the mullions 16 through fastening apertures 152. As seen in FIGS. 1 and 2, when the brackets 150 are in position, the brackets 150 extend outwardly in the same orientation as the upper insulation hangers 50. The brackets 150 may be spaced along the mullions 16 in varying locations depending on the weight of the mullion covers 35 and size of the transoms 12,14 and mullions 16. The lower leg of the brackets 150 are beveled at about a 45 degree angle to aid impaling of the curtain wall insulation 30,70 and the mullion cover 35. Once the mullion cover 35 is positioned on the bracket 150, a flat washer 51 is fastened over the lower leg of the bracket 150 retaining the mullion cover 35 in place.

Figure 5:
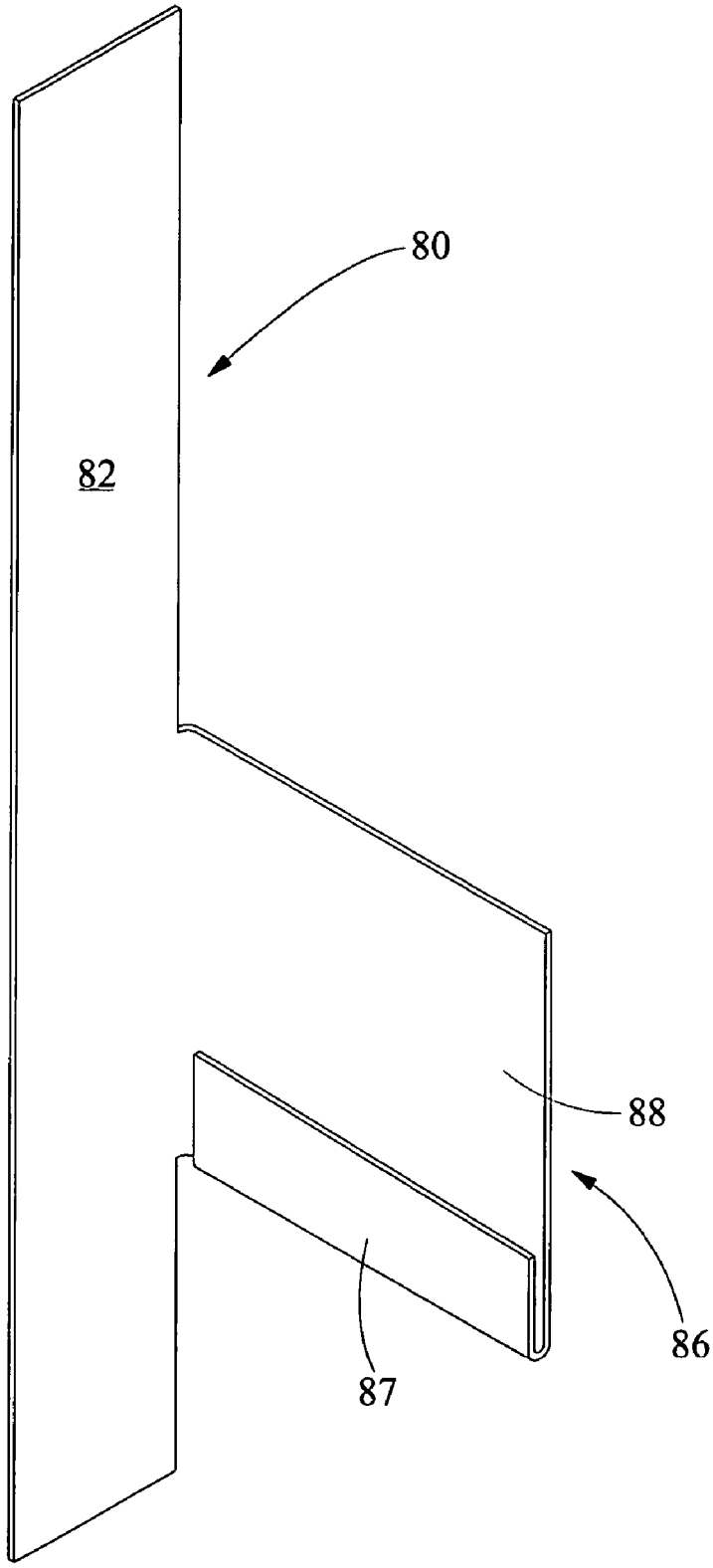
FIG. 5 is a perspective view of the backer bar hanger utilized in the interlocking curtain wall of FIG. 1.
Figure 6:
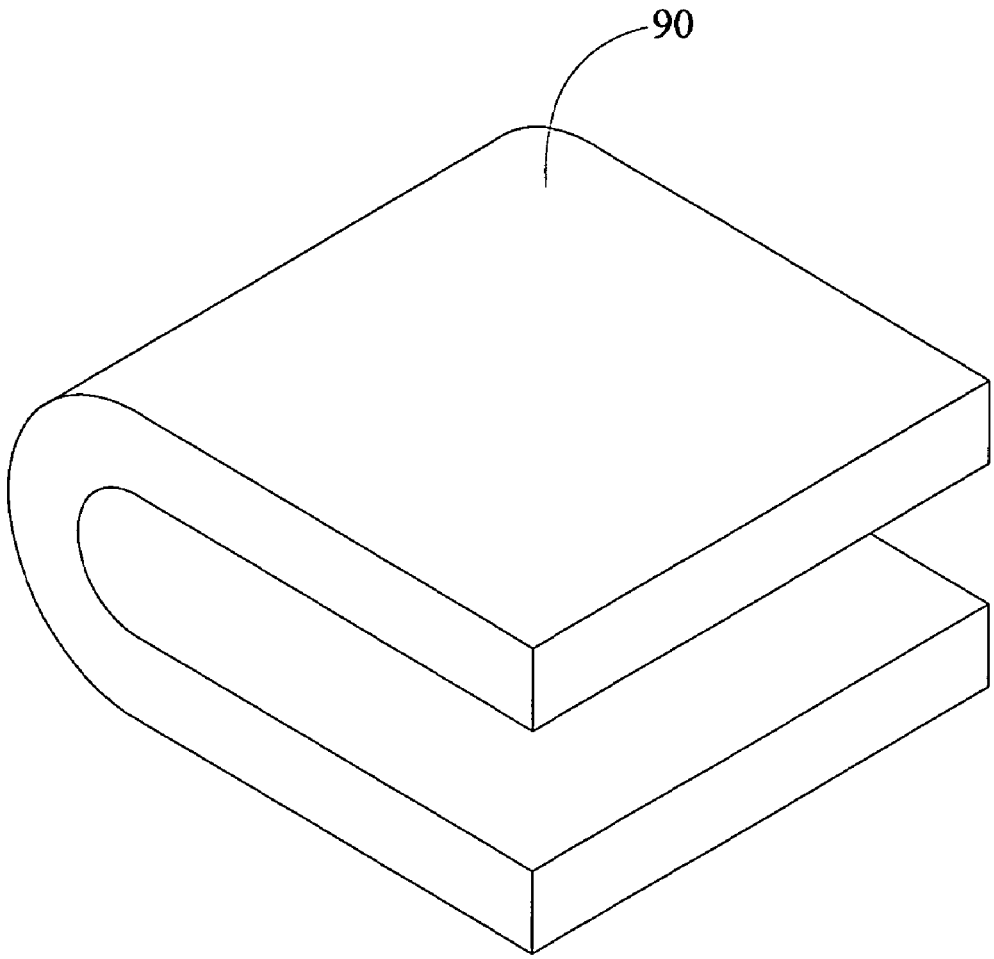
FIG. 6 is a perspective view of a clip utilized in the interlocking curtain wall of FIG. 1.

Referring now to FIGS. 2 and 5, a backer bar bracket or mullion bracket 80 is shown in side and perspective views, respectively. The mullion brackets 80 are attached to the mullions 16 and function to provide a location for support at ends of backer bar 40. In other words, the backer bar brackets 80 are positioned in opposed fashion on the mullions 16 of the building structure such that the backer bar 40 is supported by the opposed backer bar hangers 80. The backer bar hanger 80 is formed of a flat bar stock 82 and may have at least one fastening apertures (not shown) extending there through for providing positioning for a fastener or stud through the backer bar hanger 80 to the vertical mullions. As shown in FIG. 2, the backer bar bracket 80 may be fastened with fasteners or the backer bar bracket 80 may be spot welded to the vertical mullion 16 eliminating the need of fastening apertures or fasteners to be used therewith. Also extending from the backer bar bracket 80 is a retaining hook 86 which may be fastened to or otherwise integral with the flat bar stock portion 82 of backer bar bracket 80. According to one embodiment of the present invention, the retaining hook 86 may be formed by cutting and folding a portion of flat bar stock 82 outwardly such that the folded portion defines a substantially vertical support 88 positioned substantially perpendicular the adjacent surface of the flat bar stock 82. The retaining hook 86 further comprises a bottom hook portion 87 connected to the vertical support 88. The bottom hook portion 87 has a radius wherein a lower leg of the backer bar 40 may be positioned and thereby supported from below. The vertical wall 88 provides a rear support for the backer bar 40. Once positioned on adjacent vertical mullions 16, the retaining hooks 86 are opposed at equivalent elevation to support a backer bar 40 therein in a substantially horizontal orientation as seen in FIG. 2. When the backer bar 40 is supported between opposed backer bar brackets 80, a clip 90 shown in FIGS. 2 and 6 is slidably position over the uppermost edge of the backer bar 40 and vertical support 88 of the retaining hook 86 to retain the pieces together. The clip 90 is substantially U-shaped allowing the clip 90 to be slidably positioned over and frictionally engage both the backer bar 40 and the vertical support 88 of the retaining hook 86. As shown in FIG. 2, a thermal expansion gap is provided between the end of the backer bar 40 and the backer bar flat stock portion 82. The thermal expansion gap allows for expansion and contraction of the backer bar 40 with seasonal changes and allows for thermal expansion during fires.

Figure 3:
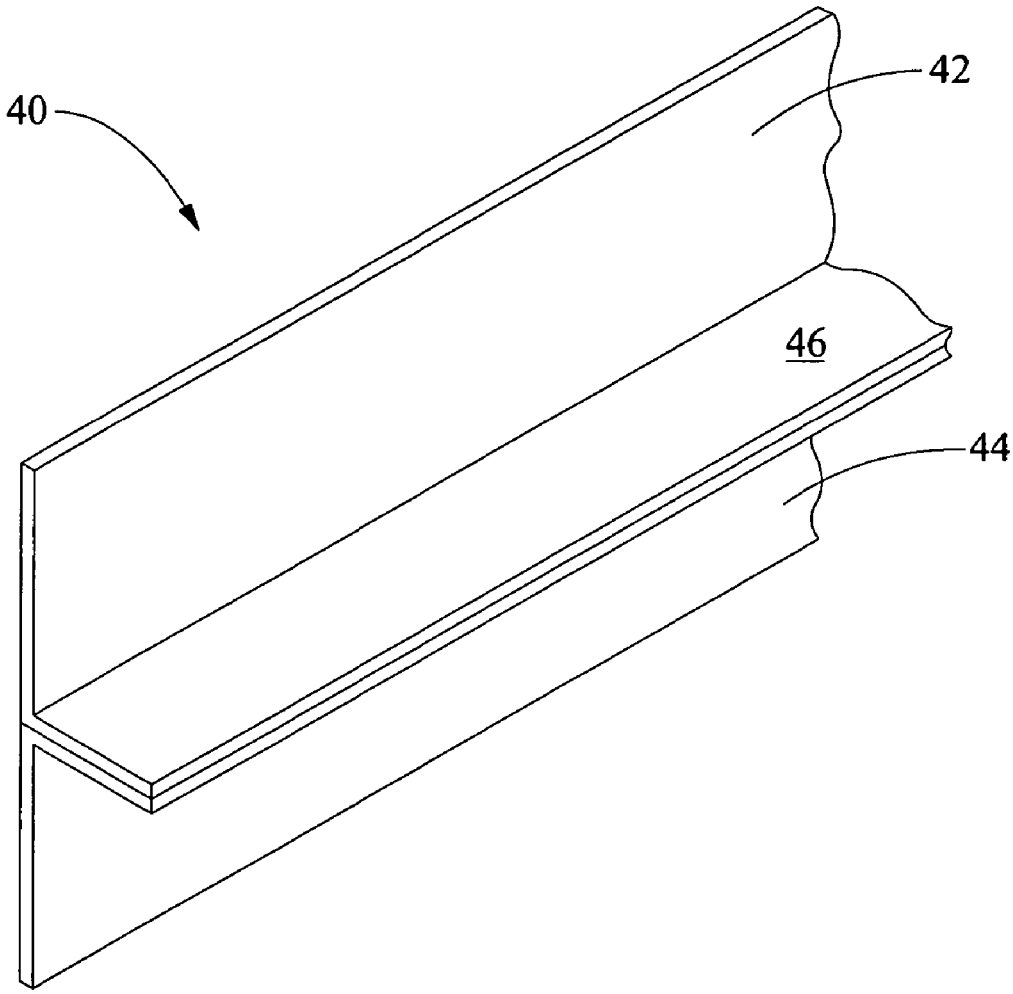
FIG. 3 is a perspective view of a backer bar utilized in the interlocking curtain wall of FIG. 1.

Referring now to FIGS. 1-3, a backer bar 40 is shown beneath the upper curtain wall 30 and adjacent to the floor slab 11. The backer bar 40 is preferably spaced from the floor slab 11 as previously discussed defining the perimeter void between the curtain wall 10 and floor slab 11 allowing the slab 11 to expand and contract relative to the steel building structure due to climate changes or during fire conditions. More specifically, the vertical leg of a lower insulation hanger 50' and the floor slab 11 define the perimeter void which, as previously indicated, allows for thermal expansion between the perimeter of the floor slab 11, for instance concrete, and the curtain wall structure including vertical mullion 16 and horizontal transom 12 for instance formed of aluminum and provide for building movement as well. Typically these perimeter voids are sized between about 1 and 9 inches, and are preferably between about 3 to 3.5 inches. The backer bar 40 is extending horizontally between and suspended by opposed backer bar brackets 80. According to the orientation of the backer bar shown in FIGS. 1-3, the backer bar 40 is substantially T-shaped having a first upper leg 42, a second lower leg 44 in the same vertical plane as the first leg 42, and a third leg 46 extending horizontally from between and being substantially perpendicular to the first and second legs 42,44. The backer bar 40 may be formed of a standard T-shaped beam or alternatively may be formed of two angle beams by placing two legs against one another and spot welding or fastening for example. The backer bar 40 may be formed of various materials including but not limited to steel, galvanized steel, ceramics and other heat resistant materials.

Referring now to FIGS. 1 and 2, at least one lower insulation hanger 50' is positioned on the third horizontal leg 46 of the backer bar 40. According to the present embodiment, lower insulation hangers 50' may be spaced apart on twelve inch (12") centers although this distance may vary according to weight, size, and other characteristics of the second lower curtain wall 70. The lower insulation hangers 50' have the same design and shape as the upper insulation hangers 50 but the lower insulation hangers are oriented differently. More specifically, the lower insulation hangers 50' are rotated about a vertical axis through about 180 degrees and an upper vertical leg of the hanger 50' may be fastened to the upper leg 42 of the backer bar 40. Thus the upper horizontal leg of the hanger 50' positioned against the third horizontal leg 46 of the backer bar 40 and a lower horizontal leg of the hanger 50' is positioned to impale and retain a lower curtain wall 70.

Referring now to FIG. 1, frictionally engaging the floor slab 11, backer bar 40 and the lower insulation hanger 50' is a safing insulation 60 which blocks the thermal expansion gap defined between the floor slab 11 and lower insulation hanger 50'. The safing insulation 60 has two functions. First, the safing insulation 60 inhibits flames and hot gases from moving from a first floor to an adjacent upper floor. Second, the safing insulation 60 protects the lower insulation hanger 50' from heat exposure and damage and therefore helps retain structural integrity of the interlocking curtain wall insulation system 10. The safing insulation 60 may be defined by mineral wool or safing insulation and is commercially available from Thermafiber, Inc. of Wabash, Ind. The thermal gap or safing insulation 60 may be formed by a single L-shaped piece of mineral wool or two pieces of the mineral wool defining the L-shaped structure. According to the illustrative embodiment and for ease of installation, the safing insulation 60 comprises an upper safing insulation 61 and a lower safing insulation 62 both of which may, for example, be formed of mineral wool insulation commercially available from the aforementioned Thermafiber, Inc. According to the present illustrative embodiment, the upper insulation may be six pound (6 Lb.) material and the lower insulation 62 may be four pound (4 Lb.) material, however one of ordinary skill in the art will understand that these specifications may vary depending on the size, spacing, and other characteristics of the installation. The upper insulation 61 extends between the floor slab 11 and the upper leg of the lower insulation hanger 50' connected to the backer bar 40. The lower insulation 62 is positioned between the slab 11 and a lower vertical surface of lower hanger bar 50'. In addition to inhibiting the spread of fire and smoke, the safing insulation 60 is preferably substantially L-shaped to provide heat resistance for the lower insulation hanger 50' and fit between the lower hanger 50' and floor slab 11. More specifically, the safing insulation 60 is positioned over the upper surface and a vertical surface of the lower hanger 50' which is opposite the floor slab 11 and extends from the floor slab 11 to the upper leg 42 of backer bar 40. The safing insulation 60 is oversized as compared to the perimeter void so that it frictionally engages the floor slab 11, the lower insulation hanger 50', and the backer bar 40 when compressed there between. The safing insulation 60 is also disposed beneath the upper curtain wall 30 so that the safing insulation 60 is fixed with respect to two planes. First, the upper curtain wall 30 and backer bar 40 inhibit upward and downward movement of the safing insulation 60. Second, the floor slab 11 and backer bar 40 inhibit horizontal movement of the safing insulation. Thus, the oversize design of the safing insulation 60 and the upper curtain wall 30 with respect to the backer bar 40 and lower insulation hanger 50' cause frictional engagement and interlocking of parts which provide structural integrity to the curtain wall system 10.

Figure 8:
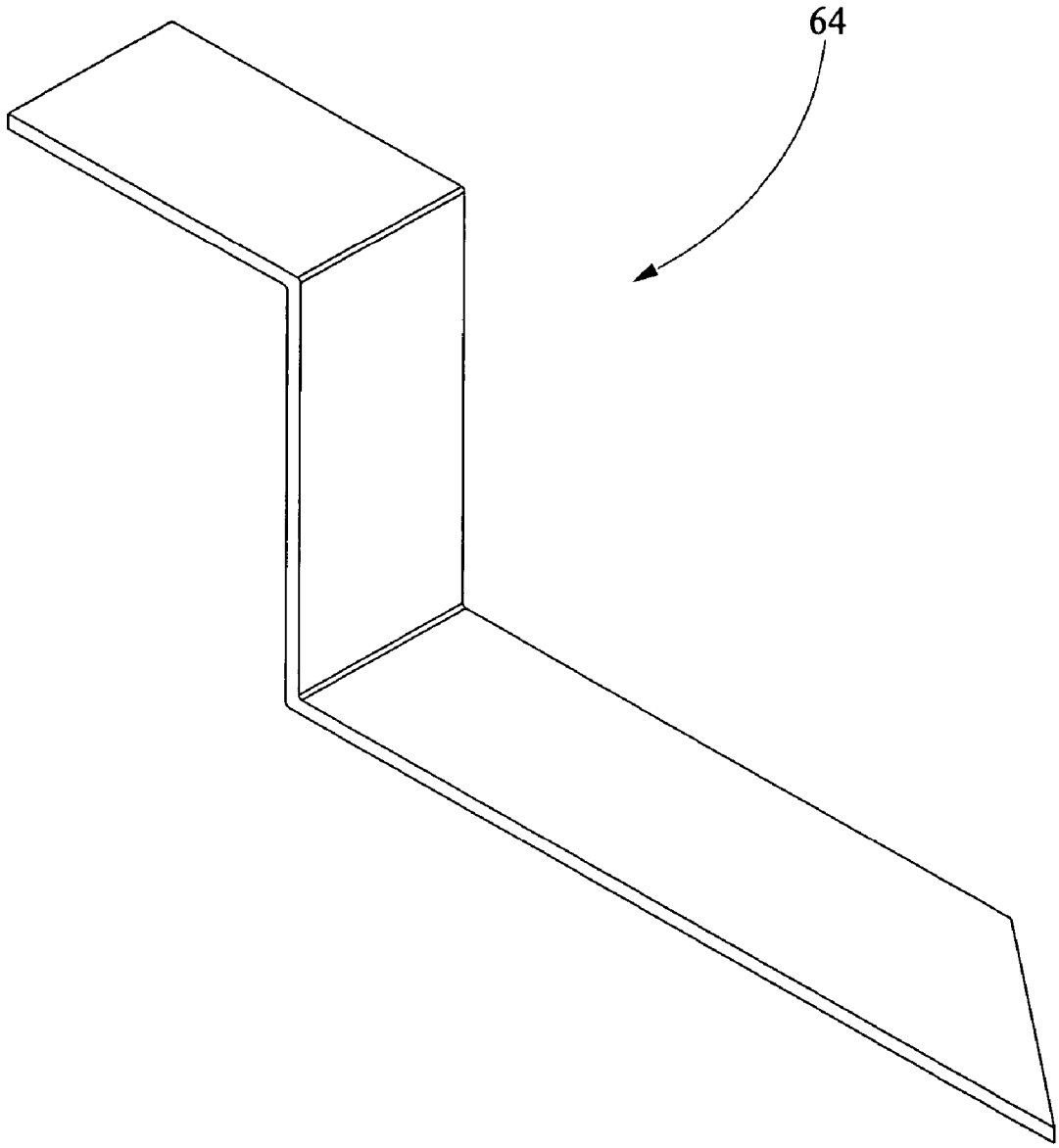

Referring now to FIGS. 1 and 8, in addition to the frictional positioning of the safing insulation 60, a safing clip 64 may be utilized to aid in retention of the safing insulation 60. The safing clip 64 may be substantially Z-shaped with at least one upper horizontal leg engaging an upper surface of floor slab 11 and a lower horizontal leg impaling the safing insulation 60 through a vertical surface adjacent the floor slab 11. A vertical leg extends between the upper and lower legs and is positioned against a vertical edge of the slab 11. If the safing clip 64 is utilized, the lower insulation hanger 50' may extend between the safing clip 64 and the backer bar 40. The safing clip 64 is protected from heat exposure by the safing insulation 60 and by the concrete floor slab 11. The safing insulation 60 is cut to a size to exceed the perimeter void size so that when positioned therein, the upper safing insulation 61 is compressed and inhibits smoke and flames from passing between the floor slab 11 and the curtain wall structure during a fire.

Depending from the upper insulation hanger 50 is the at least one upper curtain wall insulation 30. The curtain wall insulation 30 is formed of an insulating material capable of high temperature exposure. As clearly shown in FIG. 1, the curtain wall insulation 30 covers the lower horizontal leg 58 of the upper insulation hanger 50 thereby protecting the upper insulation hanger 50 from over exposure to heat during fire conditions. In other words, the insulation hangers 50 are substantially concealed in order to ensure structural integrity of the interlocking curtain wall system 10. Further as a result of this configuration, low cost material such as steel or galvanized steel may be utilized for the upper hanger 50 which need not have extreme temperature ratings thereby reducing manufacturing and consumer costs. The curtain wall insulation 30 may be formed of various materials based on desired failure temperature of the material such as mineral wool which maintains its integrity for more than five hours at temperatures of nearly 2100 degrees Fahrenheit. Such mineral wool is commercially available from the previously mentioned Thermafiber, Inc. of Wabash, Ind. The upper curtain wall 30 may have a thickness of between about 1 and 4 inches (1"-4") and have a length dependent on the height between a floor slab 11 and upper transom 12. As shown in the FIG. 1, it should be apparent to one of ordinary skill in the art that the mineral wool should be disposed between the building interior and the curtain wall structure, in order to protect the structural components defining the curtain wall 10 from a fire. Other materials may be utilized including ceramic fibers or other fire resistant materials.

The upper curtain wall 30 is suspended from the upper insulation hanger 50 and depends downwardly to the thermal gap safing insulation 60 disposed against the lower insulation hanger 20 and backer bar 40. The upper curtain wall 30 is oversized to be in compression against the safing insulation 60 thus interlocking the safing insulation 60, the upper curtain wall 30, the lower insulation hanger 50' and the backer bar 40, as previously indicated.

Referring now to FIG. 1, a lower curtain wall 70 is impaled by the lower insulation hanger 50' and depends from the lower insulation hanger 50' between the backer bar 40 and the lower transom 14. The lower insulation hanger 50' is fastened to the backer bar 40 and within the perimeter void defined by the floor slab 11 and the backer bar 40. A space is defined between the lower backer bar leg 44 and the lower vertical leg of insulation hanger 50' wherein the lower curtain wall insulation 70 is disposed by impaling with the lower insulation hanger 50'. As previously discussed the curtain wall 70 may be formed of various temperature resistant materials such as mineral wool. As seen in FIG. 2, a plurality of lower hangers 50' may be spaced on the backer bar 40 and to support the weight of the lower curtain wall 70. The positioning of the lower curtain wall 70 protects the lower backer bar leg 44 from exposure to fire, heat, and hot gases created in the room of origin.

In operation, the vertical mullions 16 and horizontal transoms 12,14 are fastened to the building skeletal structure and provide framing around spandrel openings in low, mid and high rise structures. Further the mullions 16 also provide framing around spandrel openings of a building structure in order to install the interlocking curtain wall system of the present invention. Depending from the upper transom 12 are the upper curtain wall hangers 50 which may be attached by mechanical fasteners such as rivets, screws, nuts and bolts or the like.

Next, the opposed right-hand and left-hand mullion brackets 80 are integrally fastened to the mullions 16 and a backer bar 40 is supported between the mullion brackets 80. Once the backer bar 40 is in place, clips 90 are disposed over the backer bar 40 and retaining hook 86 to retain the backer bar 40 in place.

Once the backer bar 40 is positioned, the lower curtain wall insulation 70 is disposed against the backer bar 40 between the backer bar 40 and the slab 11. With the lower curtain wall 70 positioned, the at least one lower insulation hanger 50' is fastened to the backer bar 40 and impales the lower curtain wall insulation 70 such that the lower curtain wall is sandwiched between the backer bar 40 and lower insulation hanger 50' and further depends from the at least one lower insulation hanger 50'. With the lower curtain wall 70 installed, the flat lock washer may be slidably positioned on the lower insulation hanger 50' to lock the curtain wall 70 in place as shown in the illustrative embodiment of FIG. 1. However, in a preferred embodiment, the flat washer 51 need not be positioned on the lower insulation hanger 50'.

Next, the safing clip 64 is positioned with one leg engaging the slab 11 and the lower safing insulation 62 is installed between the slab 11 lower insulation hanger 50'. The lower safing insulation 62 is impaled by the safing clip 64 and in compression. Once the lower safing insulation 62 is positioned, then the upper safing insulation 61 is installed above the lower insulation 62 and engaging the lower insulation hanger 50' and the backer bar 40.

Subsequently, the at least one upper insulation hanger 50 is fastened to the transom 12. In addition, the mullion cover brackets 150 are installed and extend from the mullions 16 in the same direction as the upper curtain wall hangers 50. Once installed, the upper curtain wall insulation 30 is impaled by the upper insulation hanger 50 and the mullion cover bracket 150 and depend therefrom engaging the upper safing insulation 61 in a compressive nature. The flat lock washers 51 are installed on the upper hangers 50 locking the upper curtain wall 30 in place. Finally the mullion covers 35 are attached to the system 10 by impaling the covers 35 with the brackets 150. To lock the mullion covers 35 in place, the flat washers 51 are disposed on the brackets 150 as shown in FIG. 7 and any seams are taped as necessary. Once installation is complete, the safing insulation is compressed in both horizontal and vertical planes. In addition, the upper and lower curtain wall insulations 30,70 are compressed and in an interlocking configuration with the safing insulation 60 inhibiting the spread of hot flame and gases from one floor to an adjacent floor.

During fire conditions the inventor has discovered that the compressed nature of the curtain wall insulation causes some rotation during expansion caused by fire and heat. This expansion creates additional sealing between the slab 11 and the backer bar 40.

It is apparent that variations may be made to the interlocking curtain wall system of the present invention in regards to specific design elements thereof. Such variations however are deemed to fall within the teachings of the present invention as generally modifications may be made to placement of the particular structure described herein while falling within the general teachings hereof.

I claim:

1. An interlocking curtain wall insulation system, comprising:

a first insulation hanger;

a first insulation curtain wall depending from said first insulation hanger and compressing a safing insulation against a second insulation hanger;

a backer bar supporting said second insulation hanger and providing a compression fit between said first insulation curtain wall and said safing insulation;

a second insulation curtain wall depending from said second insulation hanger;

said backer bar spaced apart from a floor slab and defining a void therebetween;

said safing insulation being compression fit between said second insulation hanger and said floor slab.

2. The interlocking curtain wall insulation system of claim 1, said second curtain wall insulation compressed between said second insulation hanger and said backer bar.

3. The interlocking curtain wall insulation system of claim 1, said safing insulation being substantially L-shaped.

4. The interlocking curtain wall insulation system of claim 1, said second insulation hanger disposed against at least one surface of said backer bar.

5. The interlocking curtain wall insulation system of claim 1 further comprising a safing clip having a first leg attached to said slab and a second leg engaging said safing insulation.

6. The interlocking curtain wall insulation system of claim 5, said safing clip further comprising an impaling end engaging said second insulation curtain wall.

7. The interlocking curtain wall insulation system of claim 1 further comprising a backer bar hanger fastened to a support structure and supporting said backer bar.

8. The interlocking curtain wall insulation system of claim 7, said backer bar hanger having a support extending from at least one surface.

9. The interlocking curtain wall insulation system of claim 8, said backer bar being seated in said support.

10. The interlocking curtain wall insulation system of claim 9 further comprising a clearance gap between said backer bar and said backer bar hanger.

11. An interlocking curtain wall insulation system, comprising:

a lower curtain wall insulation having an upper portion compressed between a backer bar and an insulation hanger;

a substantially L-shaped safing insulation extending along an upper side of said insulation hanger and an upper arm of said backer bar;

a floor slab spaced from said backer bar;

a void defined between said floor slab and said backer bar;

said insulation hanger disposed between said safing insulation and said backer bar;

an upper curtain wall insulation compression fit against said safing insulation.

12. The interlocking curtain wall insulation system of claim 11, said safing insulation compressed between a vertical leg of said backer bar and a floor slab.

13. The interlocking curtain wall insulation system of claim 11 further comprising backer bar hangers positioned at each end of said backer bar.

14. The interlocking curtain wall insulation system of claim 13, further comprising a thermal expansion gap between said backer bar hanger and said backer bar.

15. The interlocking curtain wall insulation system of claim 11, said upper curtain wall insulation depending from an upper insulation hanger to said safing insulation.

16. An interlocking curtain wall insulation system, comprising:

a first insulation hanger;

a first insulation curtain wall depending from said first insulation hanger and compressing a safing insulation against a second insulation hanger;

a backer bar supporting said second insulation hanger and providing a compression fit between said first insulation curtain wall and said safing insulation;

a second insulation curtain wall depending from said second insulation hanger;

said backer bar spaced apart from a floor slab and defining a void therebetween;

said safing insulation being substantially L-shaped.

* * * * *